US006558172B2

(12) United States Patent
Kanagawa

(10) Patent No.: US 6,558,172 B2
(45) Date of Patent: May 6, 2003

(54) SHIELDING CONNECTOR AND MANUFACTURING METHOD THEREOF

(75) Inventor: Shuichi Kanagawa, Nagoya (JP)

(73) Assignees: Autonetworks Technologies, Ltd., Nagoya (JP); Sumitomo Wiring Systems, Ltd., Yokkaichi (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 10/043,117

(22) Filed: Jan. 14, 2002

(65) Prior Publication Data

US 2002/0102872 A1 Aug. 1, 2002

(30) Foreign Application Priority Data

Jan. 30, 2001 (JP) ..... 2001-021370

(51) Int. Cl.[7] ..... H01R 4/66; H01R 13/648
(52) U.S. Cl. ..... 439/98; 439/582; 439/939
(58) Field of Search ..... 439/98, 939, 582

(56) References Cited

U.S. PATENT DOCUMENTS 5,681,172 A * 10/1997 Moldenhauer ..... 439/95
5,691,506 A * 11/1997 Miyazaki et al. ..... 174/65 R
5,823,803 A * 10/1998 Majors ..... 439/98
6,042,396 A * 3/2000 Endo et al. ..... 439/98
6,053,749 A * 4/2000 Masuda et al. ..... 439/98
6,186,802 B1 * 2/2001 Masuda et al. ..... 439/95
6,261,108 B1 * 7/2001 Kanagawa et al. ..... 439/98
6,280,208 B1 * 8/2001 Masuda et al. ..... 439/98
6,419,521 B2 * 7/2002 Kanagawa et al. ..... 439/98

FOREIGN PATENT DOCUMENTS

JP 05314830 * 11/1993 ..... H01R/11/18
JP A 11-26093 1/1999 ..... H01R/13/648

* cited by examiner

*Primary Examiner*—Lynn Field
*Assistant Examiner*—Hae Moon Hyeon
(74) *Attorney, Agent, or Firm*—Oliff & Berridge, PLC

(57) ABSTRACT

A shielding wire is bent in a bent shape and also is fixed in the bent shape by a housing. In the bent portion of the shielding wire, a core wire and a shielding layer are exposed by removing an outer coating and an inner insulating layer and also an insulating member, which may be heat-shrinkable, is interposed between the core wire and the shielding layer. When the insulating member is a heat-shrinkable member, an allowable bending radius of the shielding wire becomes smaller if the core wire is covered with the insulating member and bent before shrinkage, compared with the case of the core wire being bent together with the outer coating and the inner insulating layer. This results in miniaturization of the bent portion.

9 Claims, 8 Drawing Sheets

SHIELDING CONNECTOR AND MANUFACTURING METHOD THEREOF

BACKGROUND OF THE INVENTION

1. Technical Field

The present invention relates to a shielding connector and a manufacturing method thereof.

2. Related Art

Conventionally, as one example of a shielding connector of this kind, in the shielding connector disclosed in the Unexamined Japanese Patent Application No. Hei11-26093, as shown in FIGS. 8 and 9, a rubber ring 2, a holding ring 3, a conductive sleeve 4 and a press ring 5 are provided within a pipe-shaped housing 1 extending straight and further a structure in which a conduction contact piece 6 is placed on the front end outer circumference of the housing 1 is formed. Then, the housing 1 is mounted so as to cover the end of a shielding wire 10, and the top side from a flange of the housing 1 is fitted in a through hole formed in a shielding wall of the opposite side, and a part of the flange is screwed in the shielding wall of the opposite side by a bolt (not shown).

3. Problems to be Solved

By the way, due to a relation of space, the shielding wire 10 may want to be handled in a direction parallel to the shielding wall of the opposite side. However, in the conventional shielding connector described above, such a handling structure cannot be adopted. On the contrary, for example, it is considered that the pipe-shaped housing 1 described above is bent in L shape and it is formed in a configuration in which the shielding wire 10 is bent in the inside. However, since this shielding wire 10 has two resin layers made of an inner insulating layer 12 covering a core wire 11 and an outer coating 14 covering a shielding layer 13 of the outside of its layer 12, an allowable bending radius becomes large and the whole shielding connector becomes large.

Also, the conventional shielding connector has as many as six basic components (components marked with numerals 1 to 6 described above) and when fine parts other than the basic components are added, the number of parts becomes very large as shown in FIG. 9.

The invention is completed on the basis of such circumstances, and an object of the invention is to provide a shielding connector capable of handling a shielding wire in parallel with a shielding wall of the opposite side and doing miniaturization.

SUMMARY OF THE INVENTION

[Means for Solving the Problems]

As means for achieving the object, a shielding connector according to the invention of aspect 1 is characterized in that in a shielding connector for having a housing for covering the end of a shielding wire formed by coaxially laminating a core wire, an inner insulating layer, a shielding layer and an outer coating with insulation properties sequentially from the center and also conducting and connecting the shielding layer to a shielding wall of the opposite side for mounting this housing, there is provided a configuration in which in the shielding wire, the outer coating and the inner insulating layer of the end side are cut and also an insulating member is interposed between the exposed core wire and shielding layer and a portion in which this insulating member is placed is bent in L shape and also is fixed in the bent shape by the housing for covering the outside of the portion and on the other hand, the shielding layer is conducted and connected to a conductive flange which is provided protrusively sideward from the housing and also is mounted in the shielding wall of the opposite side.

The invention of aspect 2 is characterized in that in a shielding connector as defined in aspect 1, the insulating member is constructed of a heat-shrinkable insulating tube, or is formed by applying an insulating resin of a melting state to the core wire.

The invention of aspect 3 is characterized in that in a shielding connector as defined in aspect 1 or 2, the housing is formed by molding a synthetic resin around the shielding wire.

A manufacturing method of a shielding connector according to the invention of aspect 4 is characterized in that in a manufacturing method of a shielding connector for having a housing for covering the end of a shielding wire formed by coaxially laminating a core wire, an inner insulating layer, a shielding layer and an outer coating with insulation properties sequentially from the center and also conducting and connecting the shielding layer to a shielding wall of the opposite side for mounting this housing, it is constructed so that an insulating member is interposed between the core wire and the shielding layer exposed by respectively cutting the outer coating and the inner insulating layer of the end side in the shielding wire and a portion of the shielding wire in which the insulating member is placed is bent in L shape and then the shielding wire is fixed in the bent shape by providing the housing so as to cover the outside of the portion and on the other hand, a conductive flange which is conducted and connected to the shielding layer and also protrudes sideward from the housing and can be mounted in the shielding wall of the opposite side is provided.

The invention of aspect 5 is characterized in that in a manufacturing method of a shielding connector as defined in aspect 4, it is constructed so that the housing is provided by molding a synthetic resin around the shielding wire.

<Invention of Aspect 1 and Aspect 4>

The shielding layer is conducted and connected to the shielding wall through the conductive flange by mounting the conductive flange in the shielding wall. The core wire and the shielding layer are mutually insulated by the insulating The shielding wire is fixed in the bent shape by covering the shielding wire with the housing, so that the shielding wire can be handled along a direction parallel to the shielding wall of the opposite side. Since it is constructed so as to cut the inner insulating layer and the outer coating in a bent portion of the shielding wire, an allowable bending radius of the shielding wire can be reduced and thus miniaturization of the shielding connector can be achieved.

<Invention of Aspect 2>

Since the core wire is covered in an adhesion state by heating the heat-shrinkable insulating tube or is covered with a layer of the insulating resin by applying the insulating resin of the melting state, the core wire can be insulated from the shielding layer with slight space and more miniaturization of the shielding connector can be achieved.

<Invention of Aspect 3 and Aspect 5>

Since it is constructed so that the housing is provided around the shielding wire by mold molding, the number of parts can be reduced as compared with, for example, the case of a structure in which a separate housing is assembled in the shielding wire.

DETAILED DESCRIPTION OF THE PREFERRED EMBODIMENTS

Figure 1:
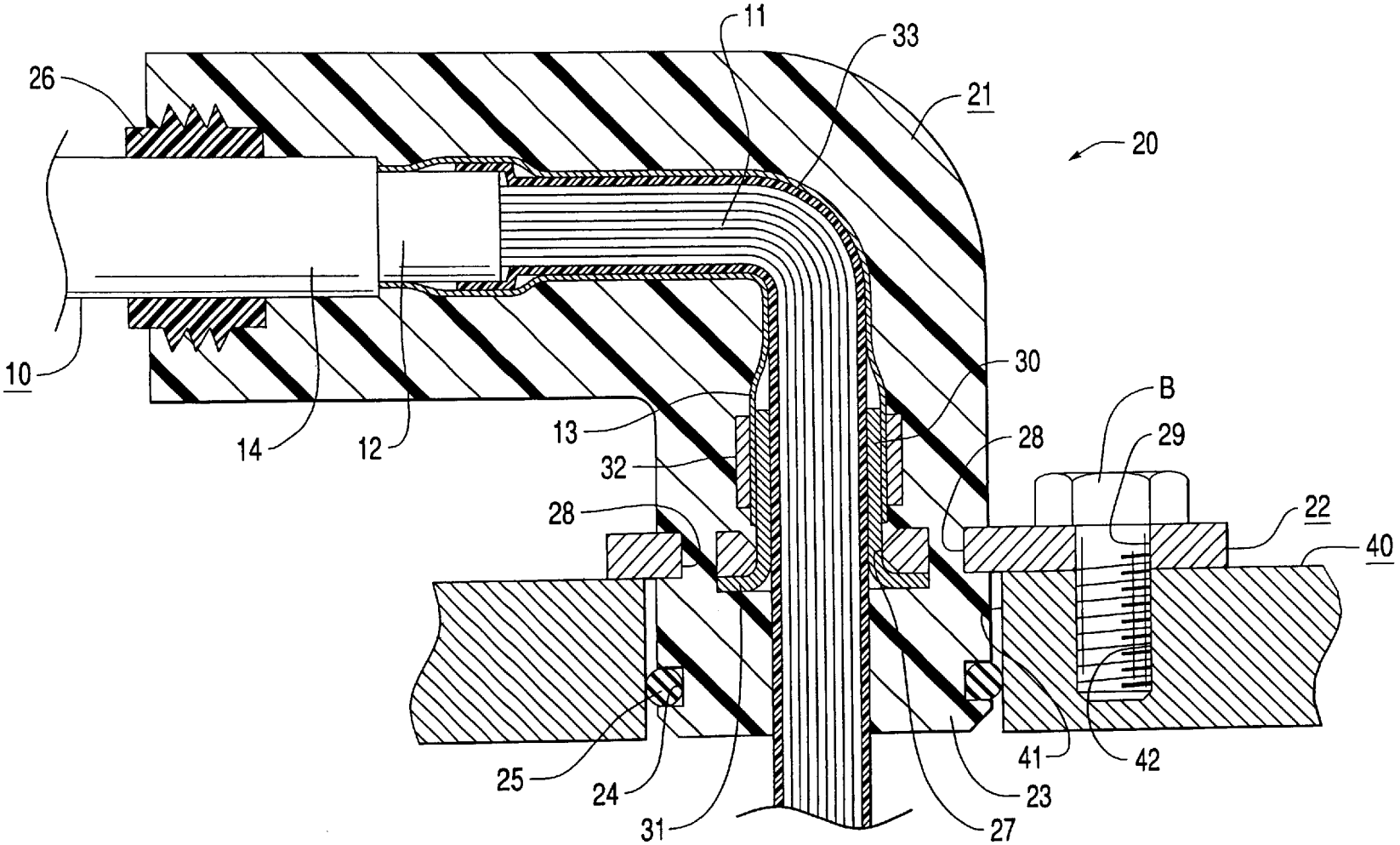
FIG. 1 is a side sectional view showing a state in which a shielding connector according to one embodiment of the invention is mounted in a shielding wall.

One embodiment of the invention will be described by FIGS. 1 to 7. As shown in FIG. 1, a shielding wire 10 has a configuration in which a core wire 11 bundling plural metal fine wires, an inner insulating layer 12 made of synthetic resin material with insulation properties, a shielding layer 13 made of a conductive braid wire and an outer coating 14 made of synthetic resin material with insulation properties sequentially from the axis are laminated coaxially. Incidentally, a thickness size of the inner insulating layer 12 of these is on the order of about 1 mm.

A shielding connector 20 of the embodiment is integrally provided in the end of the shielding wire 10 described above. In the inside of this shielding connector 20, the shielding wire 10 is bent at a substantially right angle and formed in L shape and a housing 21 made of synthetic resin (for example, nylon or PBT) with insulation properties formed in L shape along the shielding wire 10 is covered and provided around the shielding wire 10. By this housing 21, the shielding wire 10 is fixed in the bent shape.

In the housing 21, a conductive flange 22 is overhung and provided toward the side along a diameter direction from a position near to below shown in FIG. 1, and a portion lower than this conductive flange 22 is formed into an insertion part 23 capable of insertion into a mounting hole 41 provided in a shielding wall 40 of a motor. It is constructed so that a sealing groove 24 capable of fitting an O ring 25 is concavely provided on the outer circumference of this insertion part 23 and this O ring 25 adheres to the edge of the mounting hole 41 with the O ring 25 compressed and thereby the mounting hole 41 can be sealed. A waterproof pipe part 26 made of synthetic resin (for example, urethane) with insulation properties softer than the synthetic resin material forming the housing 21 is interposed between the end opposite to the insertion part 23 in the housing 21 and the outer coating 14 of the shielding wire 10.

The conductive flange 22 is constructed of a metal plate and also is formed in a non-circle (for example, pear shape). An insertion hole 27 capable of inserting the shielding wire 10 is penetratingly provided in this conductive flange 22. Plural resin inflow holes 28 for passing a melted synthetic resin material up and down in the case of molding the housing 21 as described below are penetratingly provided outside of the insertion hole 27 in the conductive flange 22. A bolt insertion hole 29 capable of inserting a bolt B for fixing the shielding connector 20 in the shielding wall 40 of the opposite side is penetratingly provided in a portion protruding to the right side shown in FIG. 1 from the housing 21 of the conductive flange 22. Also, a screw hole 42 capable of screwing the bolt B while matching with the bolt insertion hole 29 of the conductive flange 22 is provided outside of the shielding wall 40.

An inner sleeve 30 formed of metal in substantially cylindrical shape from the lower side shown in FIG. 1 is fitted into the inside of the insertion hole 27 of the conductive flange 22. In the bottom of the inner sleeve 30, a brim part 31 is provided protrusively to the outside along a diameter direction and also is engaged with the hole edge of the lower side of the insertion hole 27 in the conductive flange 22. The end opposite to the brim part 31 in the inner sleeve 30 is interposed between the shielding layer 13 in the shielding wire 10 and an insulating tube 33 described below. A crimp piece 32 made of metal is crimped in the outside of a portion in which the inner sleeve 30 is placed in the inside of the shielding layer 13, and the shielding layer 13 is held with the shielding layer 13 pressingly interposed between the crimp piece 32 and the inner sleeve 30.

Now, in the shielding wire 10, by stepwise cutting the outer coating 14 and the inner insulating layer 12 in the left side (portion extending in parallel with the shielding wall 40) shown in FIG. 1 of a bent portion, the core wire 11 and the shielding layer 13 are exposed in the range from the bent portion to the bottom side, and a heat-shrinkable insulating tube 33 is interposed between these core wire 11 and the shielding layer 13. The insulating tube 33 is provided without substantially gap in close contact with the circumference over all the range from the end of the inner insulating layer 12 to the exposed core wire 11 and the outside of this insulating tube 33 is covered with the shielding layer 13 and thereby the core wire 11 and the shielding layer 13 are kept in an insulation state mutually. In other words, the core wire 11 is protected by wrapping the insulating tube 33 over all the range from a portion extending in parallel with the shielding wall 40 with respect to the core wire 11 to a portion extending in a direction perpendicular to the shielding wall 40 through the bent portion. Also, these core wire 11 and insulating tube 33 extend downward from the insertion part 23 of the housing 21, and a terminal (not shown) crimped in the top side of the core wire 11 can be conducted and connected to a connection portion (not shown) placed within the shielding wall 40.

Figure 2:
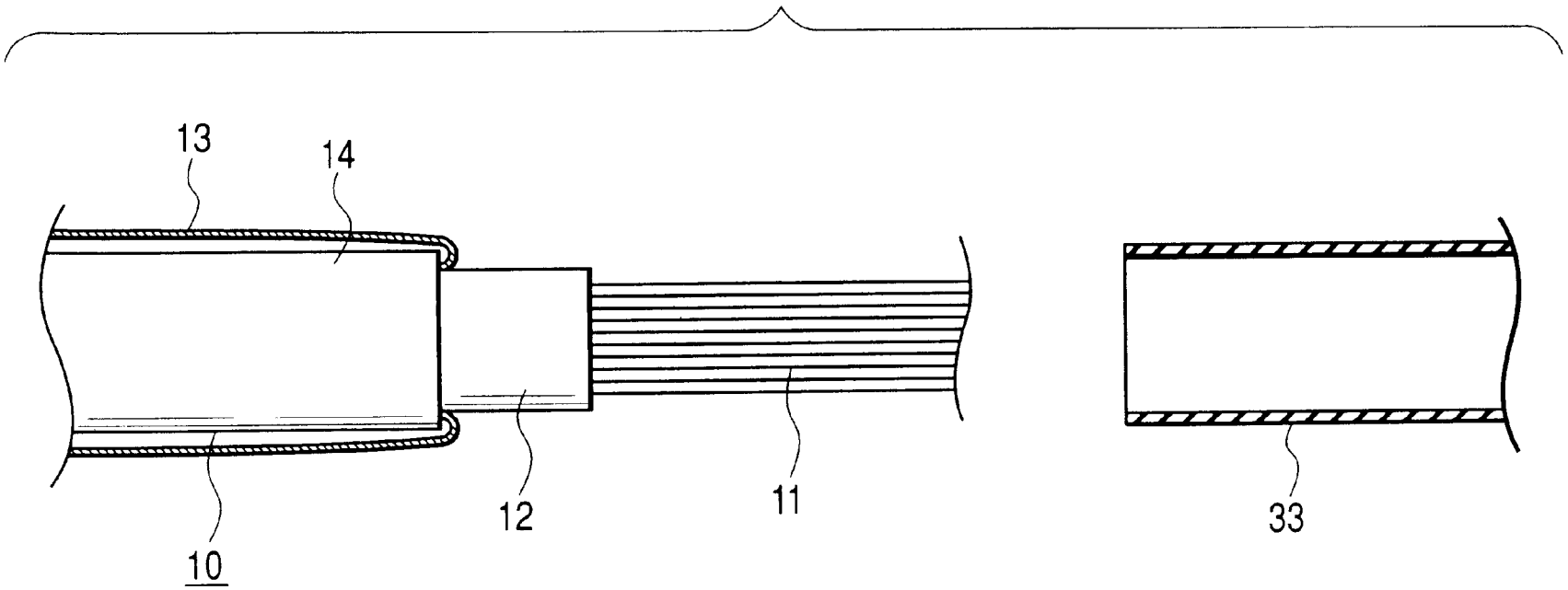
FIG. 2 is a side sectional view showing a shielding wire and an insulating tube of a state in which an outer coating and an inner insulating layer are cut and a shielding layer is reversed.

This insulating tube 33 is made of resin material with insulation properties having shrinkage properties by applying heat and as shown in FIG. 2, the shape before shrinking is formed in cylindrical shape and also the inner diameter size is set slightly larger than the outer diameter size of the inner insulating layer 12 and thereby the insulating tube 33 can be inserted while keeping a predetermined gap with respect to the core wire 11 and the inner insulating layer 12. This insulating tube 33 is formed in the order of about 0.5 mm in thickness size and is thinner and softer than the inner insulating layer 12. An allowable bending radius in the case of bending the core wire 11 together with the insulating tube 33 with this insulating tube 33 wrapped in the core wire 11 becomes sufficiently smaller than the case of bending a portion in which the inner insulating layer 12 and the outer coating 14 in the shielding wire 10 are left.

Figure 3:
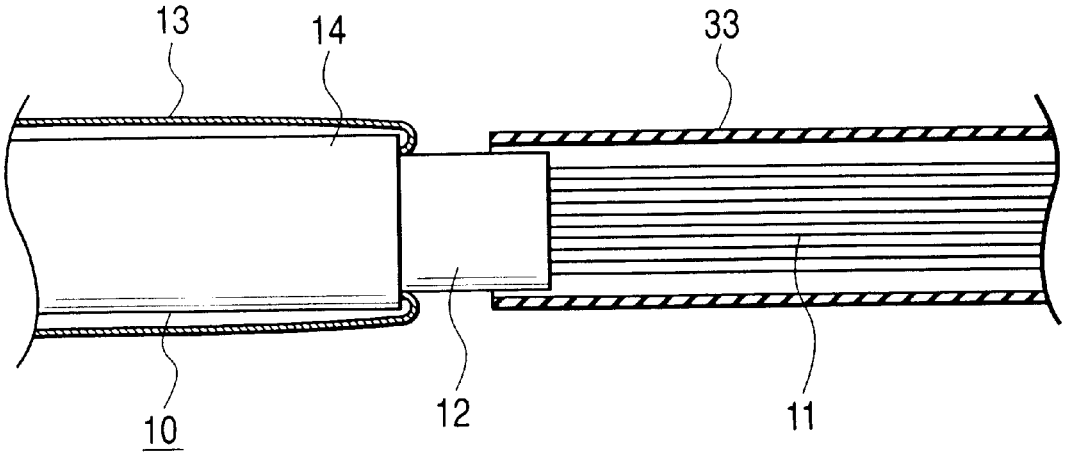
FIG. 3 is a side sectional view showing a state in which the insulating tube is idly inserted into a core wire and the inner insulating layer.

Next, a manufacturing process of a shielding connector 20 will be described. First, as shown in FIG. 2, in the end of a shielding wire 10 of a straight extending state, an outer coating 14 is cut to expose a shielding layer 13 and also the shielding layer 13 is reversed and the outside of the outer coating 14 is covered with the shielding layer 13 and thereafter cutting is performed with the exposed inner insulating layer left by a predetermined size and there by a core wire 11 is exposed. Thereafter, as shown in FIG. 3, an insulating tube 33 is idly inserted in the outside of the core wire 11 from the right side of the shielding wire 10 and is inserted to a position in which the left end of the insulating tube 33 overlaps with the right end of an inner insulating layer 12. In this case, the insulating tube 33 is spaced at a predetermined gap with respect to the inner insulating layer 12 and the core wire 11.

Figure 4:
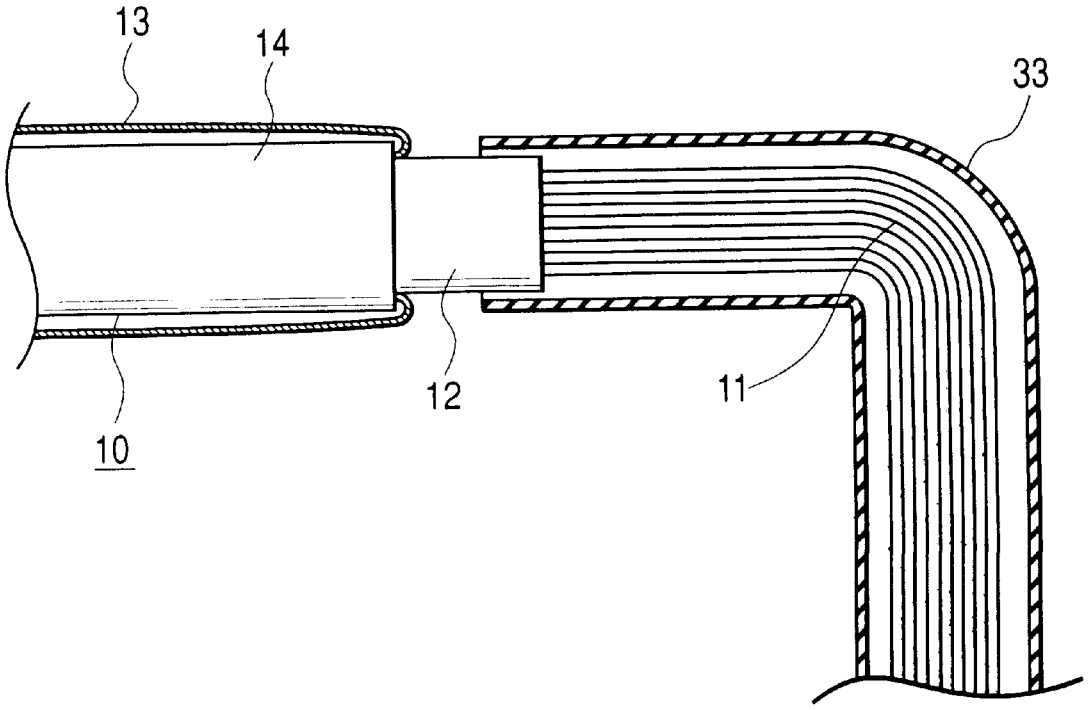
FIG. 4 is a side sectional view showing a state in which the insulating tube together with the core wire are bent.
Figure 5:
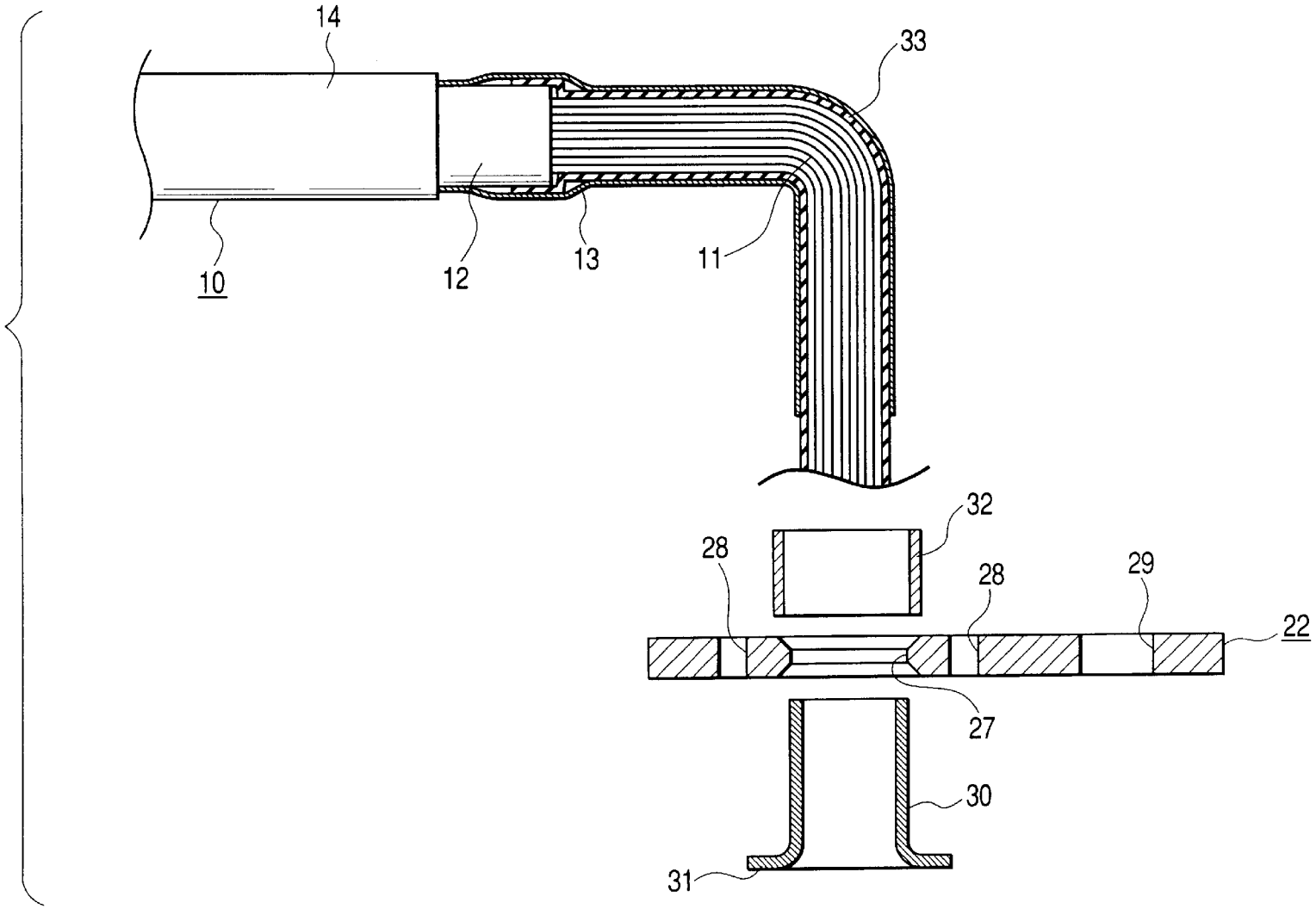
FIG. 5 is a side sectional view showing the shielding wire, a crimp piece, a conductive flange and an inner sleeve of a state in which the insulating tube is shrunken and the outside is covered with the shielding layer.

Then, as shown in FIG. 4, the core wire 11 together with the insulating tube 33 are bent at a substantially right angle so that the extending end side turns downward. In this case, since the insulating tube 33 is in an idle insertion state with respect to the core wire 11, force necessary to bend these or an allowable bending radius becomes the substantially same size as that of the case of bending only the core wire 11. When the core wire 11 and the insulating tube 33 are bent, the insulating tube 33 is shrunken by performing heating by spraying hot air with the order of about 100° C. to the insulating tube 33 through a heater such as a dryer while keeping so that the insulating tube 33 overlaps with the end of the inner insulating layer 12. As a result of this, the insulating tube 33 adheres around the core wire 11 and the inner insulating layer 12 without substantially gap while shrinking and thereby the core wire 11 is held at the shape bent in L shape. In this state, the shielding layer 13 reversed to the side of the outer coating 14 is returned and the outside of the insulating tube 33 is covered with the shielding layer 13 as shown in FIG. 5.

Figure 6:
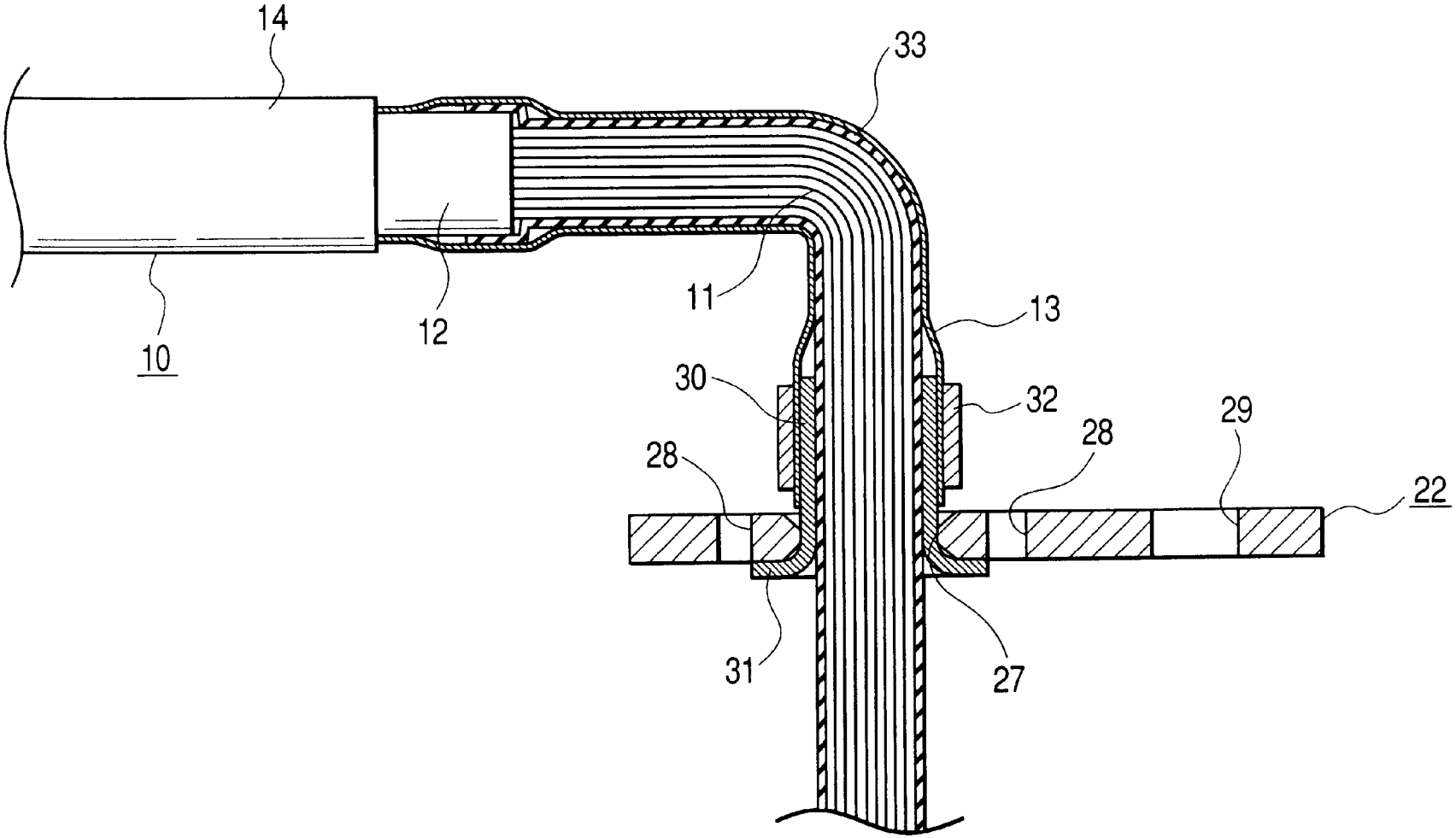
FIG. 6 is a side sectional view showing a state in which the crimp piece, the conductive flange and the inner sleeve are assembled in the shielding wire.

On the other hand, a pipe portion of an inner sleeve 30 is inserted into an insertion hole 27 of a conductive flange 22 from the lower portion and the brim part 31 is engaged with the hole edge of the lower side of the insertion hole 27. Then, while inserting the core wire 11 of the shielding wire 10 and the insulating tube 33 adhering around the core wire 11 into the inner sleeve 30 (the insertion hole 27 of the conductive flange 22), the top portion protruding upward from the conductive flange 22 of the inner sleeve 30 is inserted between the insulating tube 33 and the shielding layer 13. In this state, as shown in FIG. 6, by crimping a crimp piece 32 from the outside of the shielding layer 13, the shielding layer 13 is held in a state of being pressingly interposed between the inner sleeve 30 and the crimp piece 32. In this case, the core wire 11 and the insulating tube 33 extend downward from the conductive flange 22 and the inner sleeve 30. Also, a terminal (not shown) is crimped and connected to the extending end of the core wire 11.

Figure 7:
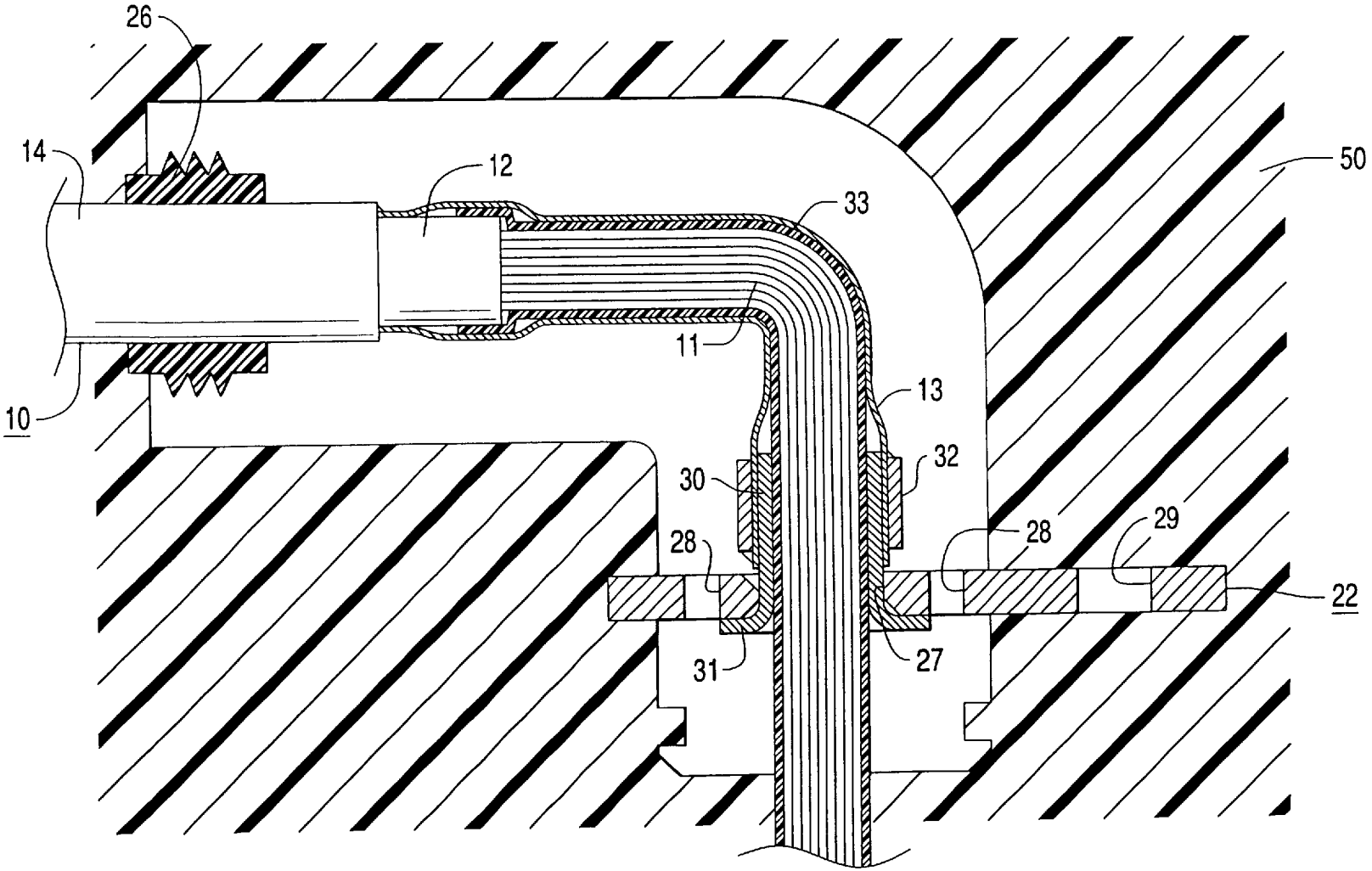
FIG. 7 is a side sectional view showing a state in which a material obtained by primary molding is set inside a mold for secondary molding.
Figure 8:
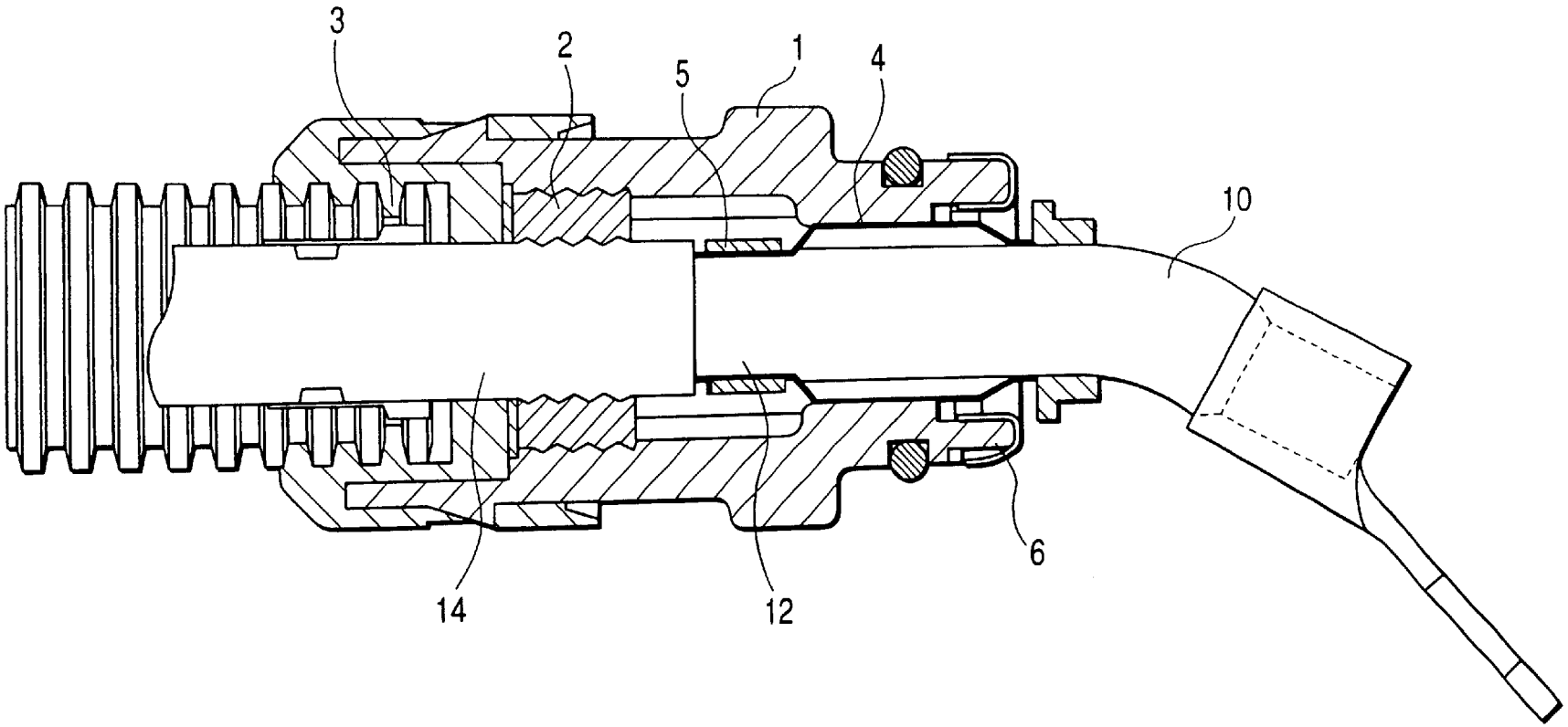
FIG. 8 PRIOR ART
FIG. 8 is a side sectional view of a conventional example.
Figure 9:
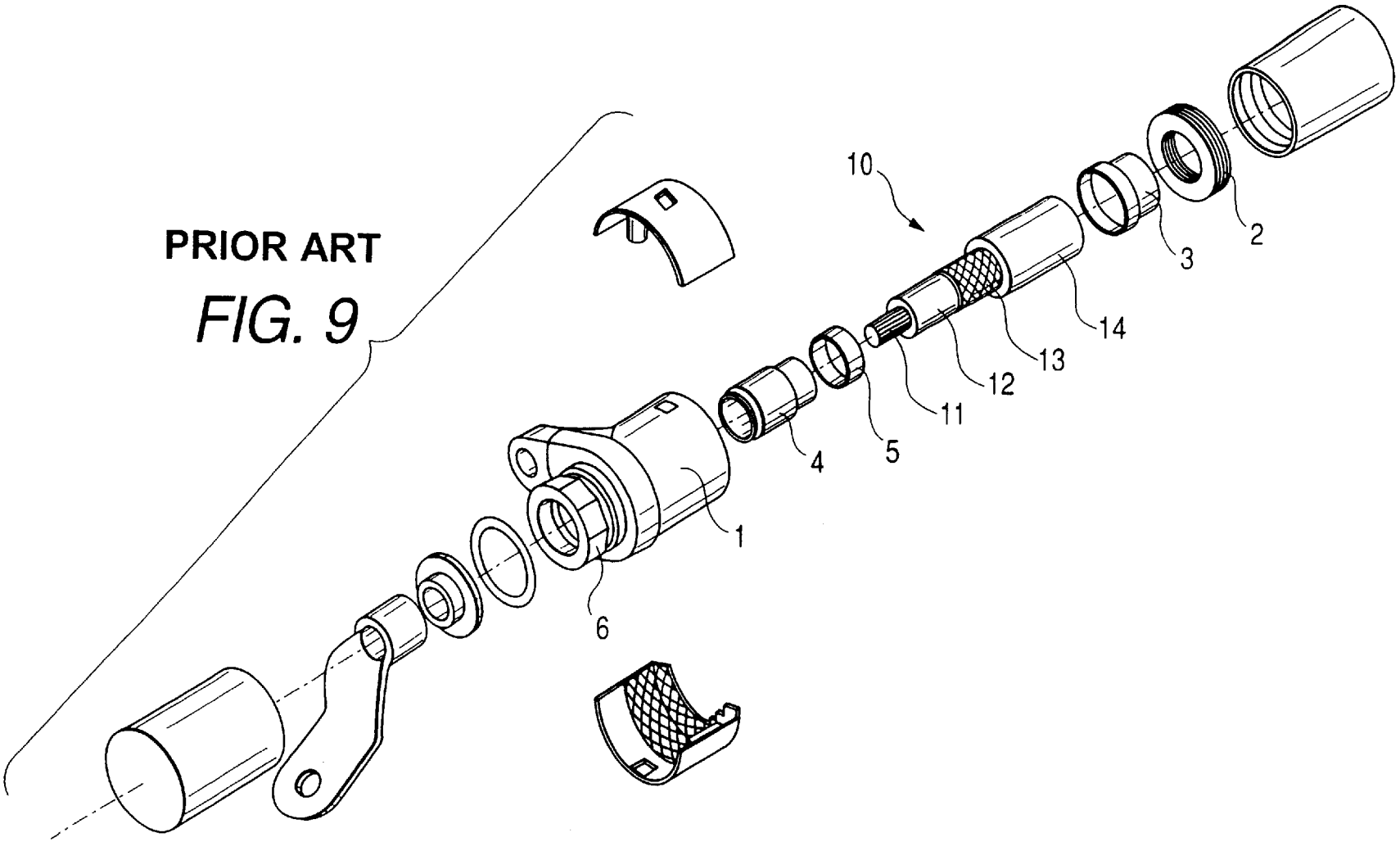
PRIOR ART FIG. 9
FIG. 9 is an exploded perspective view of the conventional example.

After the shielding wire 10 assembled in this manner is set inside a mold for primary molding (not shown) for performing primary molding, the mold is filled with a synthetic resin material (for example, urethane) of a melting state, and a waterproof pipe part 26 is formed by performing mold opening at the time when this synthetic resin material hardens (see FIG. 7). Subsequently, after the material in which the primary molding is performed is set inside a mold 50 for secondary molding for performing secondary molding as shown in FIG. 7, the mold 50 is filled with a synthetic resin material (for example, nylon or PBT) of a melting state. In this case, the melting resin passes through resin inflow holes 28 of the conductive flange 22 and spreads to the upper and lower portions of the conductive flange 22. Then, an L-shaped housing 21 bent along the shielding wire 10 is formed by performing mold opening at the time when the melting resin hardens. By this housing 21, the shielding wire 10 is fixed in the shape bent in L shape. Thereafter, by fitting an O ring 25 in a sealing groove 24 of the housing 21, the molding and assembly of the shielding connector 20 are completed (see FIG. 1). Incidentally, when the shielding wire 10 is set in a desired position inside the mold at the time of the mold molding, the shrunken and hardened insulating tube 33 adheres to the core wire 11 and thereby the core wire 11 is held in the shape bent in L shape, so that setting of the shielding wire 10 can be made easily.

The shielding connector 20 manufactured as described above is mounted in a shielding wall 40 of a motor. In the case of the mounting, first, an insertion part 23 of the housing 21 is fitted into a mounting hole 41 while passing through the mounting hole 41 from the top side of the core wire 11 and the insulating tube 33 guided downward from the bottom of the housing 21. By screwing a bolt B passing through a bolt insertion hole 29 in a screw hole 42 while pressing the conductive flange 22 on the opening edge of the mounting hole 41, as shown in FIG. 1, the shielding connector 20 is fixed in the shielding wall 40 of the opposite side. Then, the shielding layer 13 is conducted and connected to the shielding wall 40 through the inner sleeve 30 and the conductive flange 22. Also, the O ring 25 fitted into the insertion part 23 of the housing 21 adheres to the edge of the mounting hole 41 and thereby sealing of the mounting hole 41 is achieved. Also, a terminal (not shown) connected to the core wire 11 is connected to a connection portion of the side of equipment (not shown) in the inside of the shielding wall 40.

At this time, in the outside of the shielding wall 40, the shielding wire 10 guided leftward from the left end of the housing 21 extends along a direction parallel to the shielding wall 40. Here, the core wire 11 of the shielding wire 10 is bent in L shape, but its allowable bending radius becomes smaller as compared with a portion providing the outer coating 14 and the inner insulating layer 12 of the shielding wire 10, so that miniaturization of a bent portion is achieved and thus miniaturization of the whole shielding connector 20 is achieved. As a result of this, even in the case of placing another equipment (not shown) above the shielding wall 40, a distance between the equipment and the shielding wall 40 can be reduced and thus space savings can be implemented.

According to the embodiment as described above, by covering the circumference of the shielding wire 10 bent in L shape with the housing 21, the shielding wire 10 is fixed in the bent shape, so that the shielding wire 10 can be handled along a direction parallel to the shielding wall 40 of the opposite side. Since it is constructed so as to cut the inner insulating layer 12 and the outer coating 14 in a bent portion of the shielding wire 10, an allowable bending radius of the shielding wire 10 can be reduced and thus miniaturization of the shielding connector 20 can be achieved.

In addition, since it is constructed so that the heat-shrinkable insulating tube 33 is heated to cover the core wire 11 in an adhesion state, the core wire 11 can be insulated from the shielding layer 13 with slight space and more miniaturization of the shielding connector 20 can be achieved and also mounting operations of the insulating tube 33 to the shielding wire 10 can be performed easily.

Further, since it is constructed so that a synthetic resin material is molded in the shielding wire 10 and the housing 21 is molded, the number of parts can be reduced remarkably as compared with, for example, the case of mounting a separately manufactured housing 21 in the shielding wire 10.

OTHER EMBODIMENTS

The invention is not limited to the embodiment described by the description and drawings, and for example, the following embodiments are also included in the technical scope of the invention and further various changes can be made without departing from the points in addition to the following.

(1) In the embodiment described above, the case of inserting the insulating tube with the core wire of the shielding wire being straight is shown, but its procedure may be reverse and it may be constructed so that the core wire of the shielding wire is bent and then the insulating tube is inserted.

(2) In the embodiment described above, the case of using the heat-shrinkable insulating tube as an insulating member is shown, but in addition, for example, a case constructed so as to apply a melt of a synthetic resin material with insulation properties to the core wire is included in the invention.

(3) In the embodiment described above, the case that the shielding layer of the shielding wire is directly connected to the inner sleeve mounted in the conductive flange is shown, but it may be constructed so that the shielding layer of the shielding wire is connected to the inner sleeve of the conductive flange through a separately formed shielding layer. Specifically, there is provided a configuration in which the shielding layer of the shielding wire is fixed in a position short of the insulating tube and also, for example, a shielding layer with bend shape made of a conductive braid wire or metal pipe is separately formed and one end of the shielding layer is conducted and connected to the end of the shielding layer of the shielding wire and the other end is conducted and connected to the inner sleeve mounted in the conductive flange. Here, the shielding layer linking to the shielding layer of the shielding wire is insulated from the core wire by an insulating member. In this manner, work of reversing the shielding layer of the shielding wire and work of returning it can be omitted.

(4) In the embodiment described above, a molded article according to the shielding wire is used as the housing, but, for example, there may be provided a configuration in which the housing is previously molded and is assembled in the shielding wire. Specifically, there may be provided a configuration in which a configuration in which a pipe-shaped housing bent in L shape is divided into two longitudinal portions is provided and after the core wire of the shielding wire and the insulating tube are bent in L shape, it is held and assembled so as to interpose those between the housings divided into the two portions.

[FIG. 1]

10: Shielding Wire
11: Core Wire
12: Inner Insulating Layer
13: Shielding Layer
14: Outer Coating
20: Shielding Connector
21: Housing
22: Conductive Flange
27: Insertion Hole
33: Insulating Tube (Insulating Member)
40: Shielding Wall

What is claimed is:

1. A shielding connector comprising:

a shielding wire comprising, in order from a center of the shielding wire, a core wire, an inner insulating layer, a shielding layer, and an outer coating with insulation properties; and a housing that covers an end of said shielding wire, and electrically connects said shielding layer to a shielding wall on which said housing mounts, wherein a portion of said outer coating and a portion of said inner insulating layer are removed, an insulating member is interposed between the core wire and the shielding layer, a portion of said core wire at which said insulating member is placed is bent in a bent shape, and is fixed in the bent shape by said housing, and said shielding layer is electrically connected to a conductive flange which is provided protrusively sideward from said housing, and the conductive flange mounts to said shielding wall.

2. The shielding connector as defined in claim 1, wherein said insulating member is formed by a heat-shrinkable insulating tube, or is formed by applying an insulating resin of a melting state to said core wire.

3. The shielding connector as defined in claim 1, wherein said housing is formed by molding a synthetic resin around said shielding wire.

4. The shielding connector as defined in claim 1, wherein:

the bent shape is an L shape.

5. A manufacturing method of a shielding connector having a housing that covers an end of a shielding wire comprising, in order from a center of the shielding wire, a core wire, an inner insulating layer, a shielding layer, and an outer coating with insulation properties, and electrically connects said shielding layer to a shielding wall on which said housing mounts, said method comprising the steps of:

interposing an insulating member between said core wire and said shielding layer at a position at which said outer coating and said inner insulating layer have been removed, bending a portion of the shielding wire in which the insulating member is placed in a bent shape, fixing said shielding wire in the bent shape by providing said housing to cover the outside of said portion, and providing a conductive flange which electrically connects to said shielding layer, and protrudes sideward from said housing to be mounted to said shielding wall.

6. The manufacturing method of a shielding connector as defined in claim 5, wherein said housing is provided by molding a synthetic resin around said shielding wire.

7. The manufacturing method of a shielding connector as defined in claim 5, wherein:

said interposing step includes heat-shrinking the insulating member.

8. The manufacturing method of a shielding connector as defined in claim 5, wherein:

said interposing step includes applying the insulating member in a melted state.

9. The manufacturing method of a shielding connector as defined in claim 5, wherein:

the bent shape is an L shape.

* * * * *